US006854607B2

(12) United States Patent
Tong

(10) Patent No.: US 6,854,607 B2
(45) Date of Patent: Feb. 15, 2005

(54) ADJUSTABLE TOOL SUPPORT AND DISPLAY DEVICE

(76) Inventor: Hui Lin Tong, P.O. Box 63-99, Taichung (TW), 406

( * ) Notice: Subject to any disclaimer, the term of this patent is extended or adjusted under 35 U.S.C. 154(b) by 84 days.

(21) Appl. No.: 10/402,784

(22) Filed: Mar. 28, 2003

(65) Prior Publication Data

US 2004/0188366 A1 Sep. 30, 2004

(51) Int. Cl.[7] ..... A47F 7/00
(52) U.S. Cl. ..... 211/70.6; 206/378
(58) Field of Search ..... 211/70.6; 206/378, 206/377, 376, 372, 493, 806; 248/314, 317

(56) References Cited

U.S. PATENT DOCUMENTS 5,467,874 A * 11/1995 Whitaker ..... 206/378
6,044,985 A * 4/2000 Kao ..... 211/70.6
6,375,005 B1 * 4/2002 McCann ..... 206/349
6,386,363 B1 * 5/2002 Huang ..... 206/378
6,415,933 B1 * 7/2002 Kao ..... 211/70.6
6,464,840 B1 * 10/2002 McCann ..... 206/376
6,581,894 B1 * 6/2003 Tong ..... 248/314
6,669,032 B2 * 12/2003 Kao ..... 211/70.6

* cited by examiner

*Primary Examiner*—Leslie A. Braun
*Assistant Examiner*—Khoa Tran
(74) *Attorney, Agent, or Firm*—Charles E. Baxley

(57) ABSTRACT

A tool support device includes a longitudinal beam having a longitudinal rod, a longitudinal rib extended from the longitudinal rod, a coupler having a barrel slidably and rotatably engaged onto the longitudinal rod and rotatable relative to the longitudinal rod to selected angular position. The barrel includes a depression and a number of cavities communicating with the bore, to slidably receive the longitudinal rib, and to limit the barrel to rotate relative to the longitudinal rod, and to retain the longitudinal rib in either of the cavities of the barrel, and to position the barrel relative to the longitudinal rod at selected angular position.

14 Claims, 5 Drawing Sheets

ADJUSTABLE TOOL SUPPORT AND DISPLAY DEVICE

BACKGROUND OF THE INVENTION

1. Field of the Invention

The present invention relates to a tool support device, and more particularly to an adjustable tool support device for supporting and displaying tool members in different angular positions.

2. Description of the Prior Art

Typically, envelopes, package members, or the like have been provided to support and display various kinds of tool members. However, the typical tool receiving or supporting or packaging members may only be used to support the tool members, but may not be used to support the tool members at different angular position relative to the supporting or packaging members.

The present invention has arisen to mitigate and/or obviate the afore-described disadvantages of the conventional tool support devices.

SUMMARY OF THE INVENTION

The primary objective of the present invention is to provide an adjustable tool support device for supporting and displaying tool members in different angular positions.

In accordance with one aspect of the invention, there is provided a tool support device comprising a tool member, a longitudinal beam including a longitudinal rod extended therefrom, and including at least one longitudinal rib extended from the longitudinal rod, a coupler including a barrel having a bore formed therein to rotatably receive the longitudinal rod, for allowing the barrel to slide along the longitudinal rod, and to be rotated relative to the longitudinal rod to selected angular position, the barrel including a depression formed therein, and communicating with the bore thereof, to slidably receive the longitudinal rib, and to limit the barrel to rotate relative to the longitudinal rod, the barrel further including a plurality of cavities formed therein, and communicating with the depression thereof, to receive and retain the longitudinal rib in either of the cavities of the barrel, and to position the barrel relative to the longitudinal rod at selected angular position, and means for coupling the barrel to the tool member.

The longitudinal beam includes a longitudinal flange extended therefrom, and the longitudinal rod 1 is secured on the longitudinal flange, the barrel of the coupler includes a gap formed therein and defined by two ends, to receive the longitudinal flange, and to limit the barrel to rotate relative to the longitudinal rod.

The coupling means includes a plug device attached to the tool member, and an actuator extended from the coupler, to engage into the plug device and to lock the tool member to the plug device.

The tool member includes an opening formed therein, the plug device includes a housing engageable into the opening of the tool member, and includes a channel formed therein to receive the actuator, and to allow the actuator to engage into the housing of the plug device.

The housing includes at least one spring projection, the actuator includes at least one protrusion extended therefrom to engage with and to force the spring projection of the housing to engage with the tool member, and to lock the housing of the plug device to the tool member.

The coupling means includes a block extended from the barrel, a casing provided in the plug device and having a chamber formed therein, to receive the block.

A locking means may further be provided to lock and secure the coupler to the plug device. The locking means includes a flap provided between the barrel and the block of the coupler, the casing includes at least one wedge formed therein to engage with the flap of the coupler, and to lock the coupler to the plug device. The casing includes a Z-shaped slit formed therein, to increase a resilience of the wedge, and to allow the wedge to engage with the flap.

The longitudinal beam includes a handle provided thereon. The longitudinal beam includes a bar secured thereto. The longitudinal beam includes a chamber formed therein, and the bar includes an extension extended therefrom and engaged into the chamber of the longitudinal beam.

The longitudinal beam includes at least one bulge extended into the chamber thereof, the extension of the bar includes at least one slot formed therein, to slidably receive the bulge, and to position the extension of the bar to the longitudinal beam.

The extension of the bar includes a lock notch formed therein, the longitudinal beam includes a latch extended therefrom and engaged into the lock notch of the extension of the bar, to lock the bar to the longitudinal beam.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
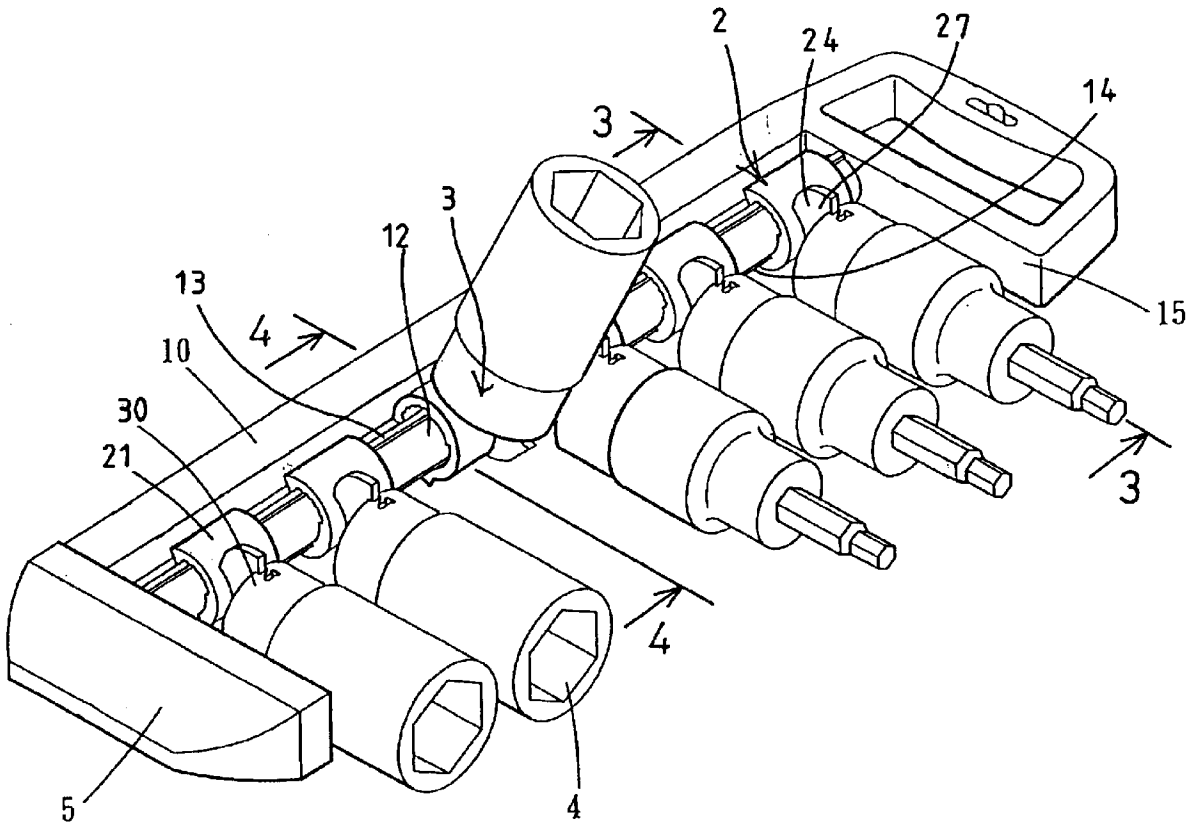
FIG. 1 is a perspective view of an adjustable tool support device in accordance with the present invention.
Figure 2:
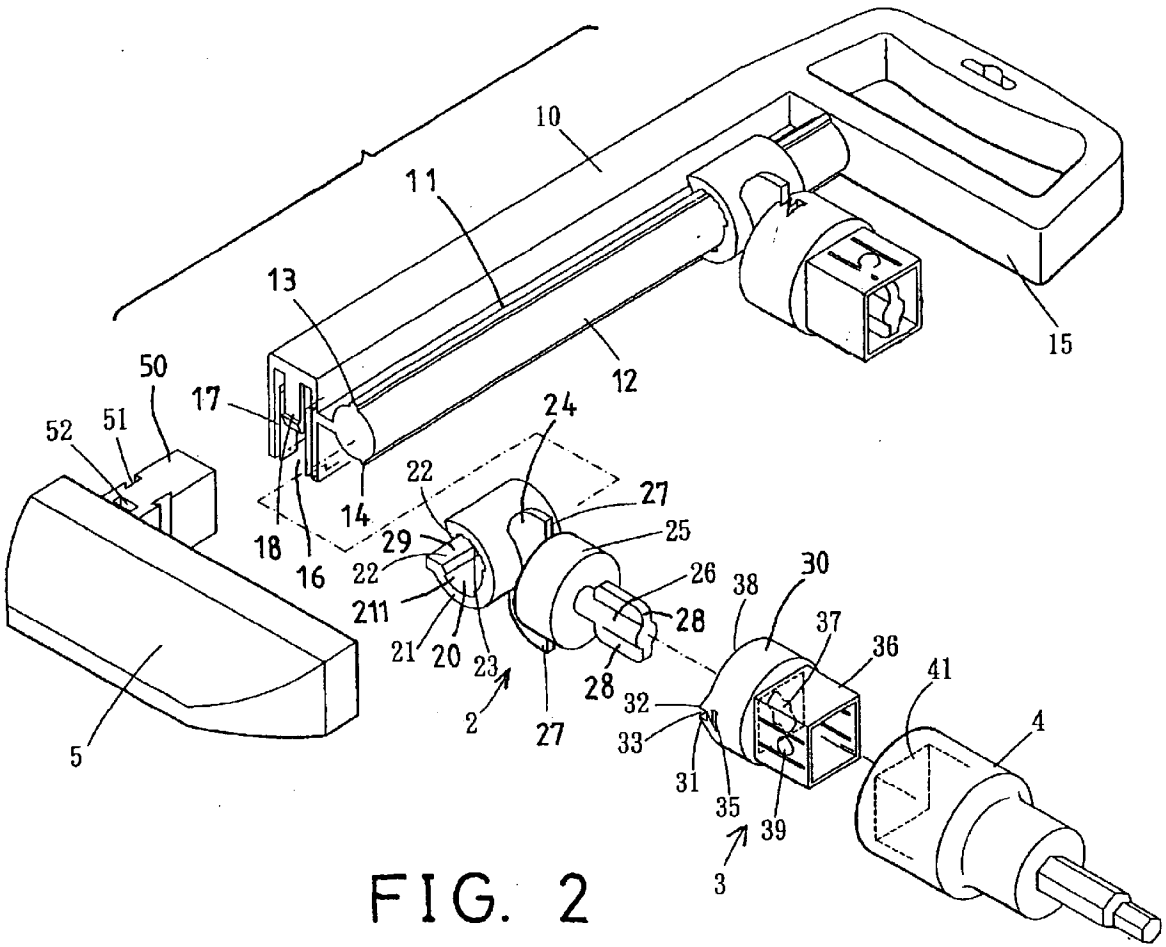
FIG. 2 is a partial exploded view of the adjustable tool support device.

Referring to the drawings, and initially to FIGS. 1–4, an adjustable tool support device in accordance with the present invention comprises a longitudinal beam 10 including a longitudinal flange 11 extended forwardly therefrom, a longitudinal rod 12 extended or formed or provided on the front portion of the longitudinal flange 11, and one or more, such as two longitudinal ribs 13, 14 are extended outwardly from the longitudinal rod 12, and spaced from each other.

The longitudinal beam 10 may include a handle 15 attached to one end thereof, and may include a chamber 16 formed therein, and one or more bulges 17 provided in the other end thereof and extended into the chamber 16 thereof, and a latch 18 provided or extended from the other end thereof.

A bar 5 includes an extension 50 extended from one end thereof, and perpendicular to the bar 5, for engaging into the chamber 16 of the longitudinal beam 10, and includes one or more slots 51 formed in the extension 50 thereof, to slidably receive the bulges 17 of the longitudinal beam 10, and to position the extension 50 of the bar 5 to the longitudinal beam 10. The extension 50 of the bar 5 includes a lock notch 52 formed therein to receive the latch 18, and for latching or locking the bar 5 to the longitudinal beam 10.

A number of couplers 2 may be slidably attached onto the longitudinal rod 12 before the bar 5 is secured to the longitudinal beam 10. However, for illustrating purposes, only one of the couplers 2 will be taken as an example, and will be described hereinafter.

The coupler 2 includes a barrel 21 having a bore 20 formed therein to rotatably receive the longitudinal rod 12, for allowing the barrel 21 of the coupler 2 to slide along the longitudinal rod 12. The barrel 21 of the coupler 2 includes a gap 29 formed therein and defined by two ends 22, to receive the longitudinal flange 11, and thus to limit the barrel 21 of the coupler 2 to rotate relative to the longitudinal rod 12, best shown in FIGS. 3 and 4.

Figure 3:
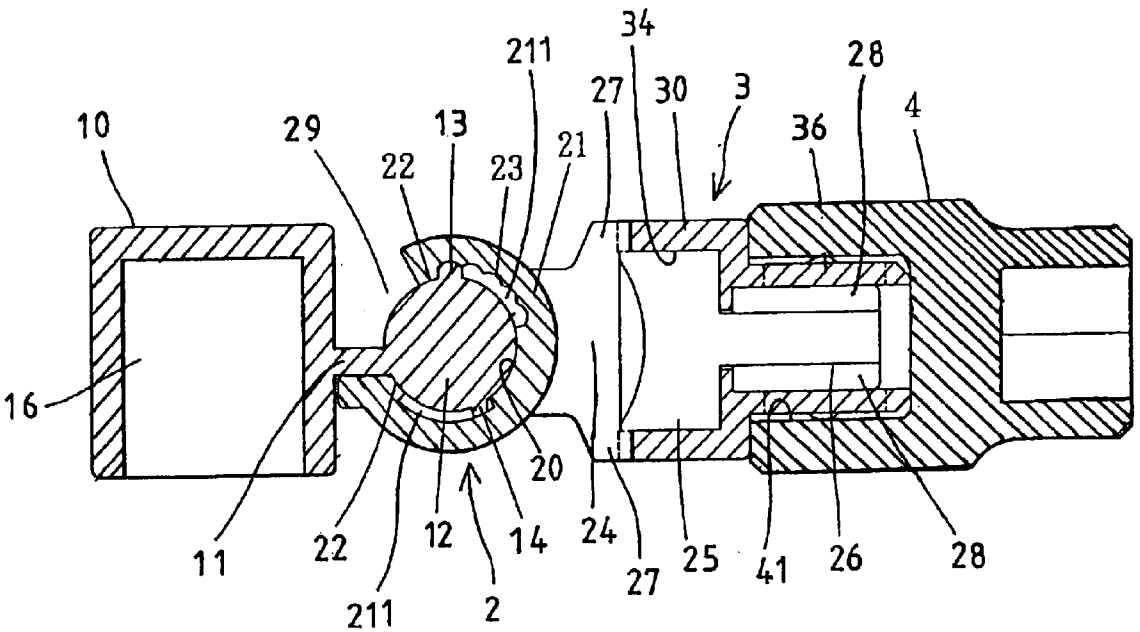
FIGS. 3, 4 are cross sectional views taken along lines 3—3 and 4—4 of FIG. 1 respectively.
Figure 4:
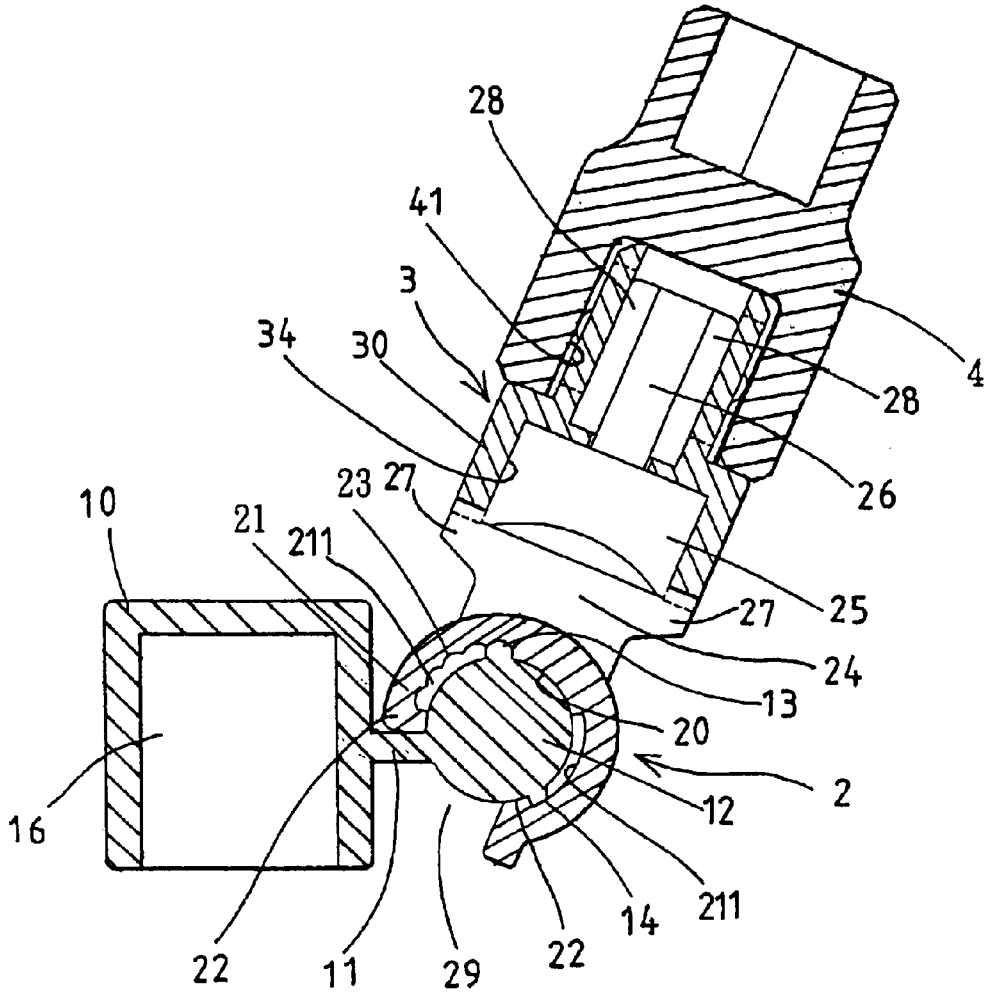

The barrel 21 of the coupler 2 further includes one or more, such as two depressions 211 formed therein, and communicating with the bore 20 thereof, to slidably receive the longitudinal ribs 13, 14 respectively, and to further limit the barrel 21 of the coupler 2 to rotate relative to the longitudinal rod 12. The barrel 21 of the coupler 2 may be rotated relative to the longitudinal rod 12 to various or different angular positions (FIGS. 1, 3, 4).

The barrel 21 of the coupler 2 further includes a number of cavities 23 formed in one of the depressions 211 thereof, and communicating with the depression 211 thereof, to receive and retain the longitudinal rib 13 in either of the cavities 23 of the barrel 21, and thus to position the barrel 21 of the coupler 2 relative to the longitudinal rod 12 at the required or selected angular position.

The coupler 2 includes a flap 24 and a block 25 extended from the barrel 21, and an actuator 26 further extended from the block 25. The flap 24 includes one or both ends or sides 27 extended outwardly beyond the block 25. The actuator 26 includes one or more, such as two opposite protrusions 28 extended therefrom.

A plug device 3 is further provided for attaching to the coupler 2, in order to couple or attach a tool member 4 to the coupler 2. The plug device 3 includes a casing 30 having a chamber 34 formed therein and defined by a peripheral wall 38, to receive the block 25 of the coupler 2. The casing 30 includes one or more notches 33 formed therein, and each defined between two ramps or wedges 31, 32, and each having a Z-shaped slit 35 formed therein, to increase the resilience of the wedges 31, 32.

The sides 27 of the flap 24 may be engaged into the corresponding notches 33 that are defined between two ramps or wedges 31, 32, in order to lock the casing 30 of the plug device 3 to the block 25 of the coupler 2. The details of the engagement of the flap 24 with the wedges 31, 32 have been disclosed in U.S. patent application Ser. No. 10/256,292 to Tong, filed 30 Sep. 2002, which is taken as a reference for the present invention.

Figure 5:
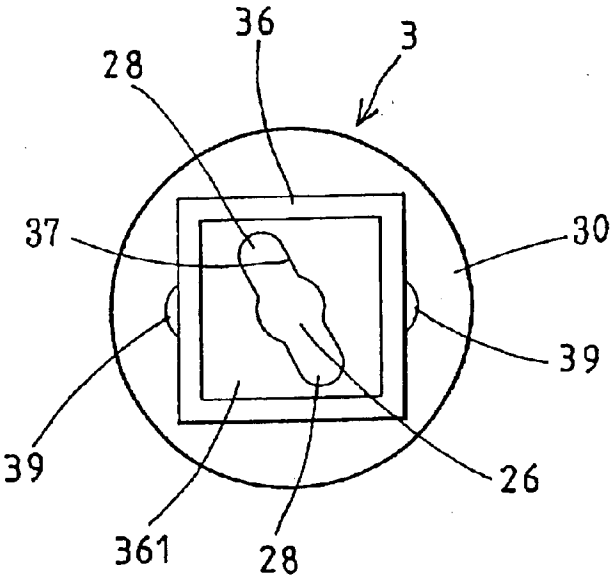
FIGS. 5, 6 are end schematic views illustrating the operation of a tool retaining device of the adjustable tool support device.
Figure 6:
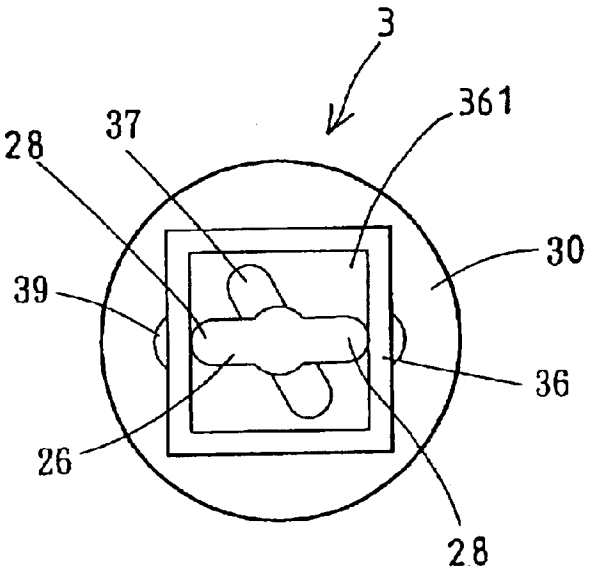

The plug device 3 further includes a housing 36 extended from the casing 31, and having one or more, such as two opposite spring projections 39 provided thereon, and a channel 37 formed in either of the casing 30 or the housing 36, or formed between the casing 30 and the housing 36, to receive the actuator 26, for allowing the actuator 26 of the coupler 2 to engage into the chamber 361 of the housing 36 (FIGS. 5, 6). The housing 36 may be engaged into an opening 41 of a tool member 4, such as a socket, a screw driving member, a tool extension, or the like.

In operation, as shown in FIGS. 5, 6, when the actuator 26 of the coupler 2 is rotated in the chamber 361 of the housing 36, the protrusions 28 of the actuator 26 may be forced to engage with the spring projections 39 of the housing 36, and to force the spring projections 39 outwardly to engage with the tool member 4, and thus to lock the tool member 4 to the housing 36 of the plug device 3.

As shown in FIG. 6, when the actuator 26 of the coupler 2 is rotated relative to the housing 36, the protrusions 28 of the actuator 26 may be disengaged from the channel 37 of the plug device 3, such that the coupler 2 may be solidly coupled to the plug device 3 and may not be disengaged from the plug device 3.

In addition, when the spring projections 39 of the housing 36 are forced outwardly to engage with the tool member 4, and to lock the tool member 4 to the housing 36 of the plug device 3, the sides 27 of the flap 24 may also be arranged to be engaged into the corresponding notches 33 that are defined between two ramps or wedges 31, 32, in order to lock the casing 30 of the plug device 3 to the block 25 of the coupler 2.

Accordingly, the adjustable tool support device in accordance with the present invention may be provided for supporting and displaying tool members in different angular positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool support device comprising:

a tool member, a longitudinal beam including a longitudinal rod extended therefrom, and including at least one longitudinal rib extended from said longitudinal rod, a coupler including a barrel having a bore formed therein to rotatably receive said longitudinal rod, for allowing said barrel to slide along said longitudinal rod, and to be rotated relative to said longitudinal rod to selected angular position, said barrel including a depression formed therein, and communicating with said bore thereof, to slidably receive said at least one longitudinal rib, and to limit said barrel to rotate relative to said longitudinal rod, said barrel further including a plurality of cavities formed therein, and communicating with said depression thereof, to receive and retain said at least one longitudinal rib in either of said cavities of said barrel, and to position said barrel relative to said longitudinal rod at selected angular position, and means for coupling said barrel to said tool member.

2. The tool support device as claimed in claim 1, wherein said longitudinal beam includes a longitudinal flange extended therefrom, and said longitudinal rod is secured on said longitudinal flange, said barrel of said coupler includes a gap formed therein and defined by two ends, to receive said longitudinal flange, and to limit said barrel to rotate relative to said longitudinal rod.

3. The tool support device as claimed in claim 1, wherein said coupling means includes a plug device attached to said tool member, and an actuator extended from said coupler, to engage into said plug device and to lock said tool member to said plug device.

4. The tool support device as claimed in claim 3, wherein said tool member includes an opening formed therein, said plug device includes a housing engageable into said opening of said tool member, and includes a channel formed therein to receive said actuator, and to allow said actuator to engage into said housing of said plug device.

5. The tool support device as claimed in claim 4, wherein said housing includes at least one spring projection, said actuator includes at least one protrusion extended therefrom to engage with and to force said at least one spring projection of said housing to engage with said tool member, and to lock said housing of said plug device to said tool member.

6. The tool support device as claimed in claim 3, wherein said coupling means includes a block extended from said barrel, a casing provided in said plug device and having a chamber formed therein, to receive said block.

7. The tool support device as claimed in claim 6 further comprising means for locking said coupler to said plug device.

8. The tool support device as claimed in claim 7, wherein said locking means includes a flap provided between said barrel and said block of said coupler, said casing includes at least one wedge formed therein to engage with said flap of said coupler, and to lock said coupler to said plug device.

9. The tool support device as claimed in claim 8, wherein said casing includes a Z-shaped slit formed therein, to increase a resilience of said at least one wedge.

10. The tool support device as claimed in claim 1, wherein said longitudinal beam includes a handle provided thereon.

11. The tool support device as claimed in claim 1, wherein said longitudinal beam includes a bar secured thereto.

12. The tool support device as claimed in claim 1, wherein said longitudinal beam includes a chamber formed therein, and a bar includes an extension extended therefrom and engaged into said chamber of said longitudinal beam.

13. The tool support device as claimed in claim 12, wherein said longitudinal beam includes at least one bulge extended into said chamber thereof, said extension of said bar includes at least one slot formed therein, to slidably receive said at least one bulge, and to position said extension of said bar to said longitudinal beam.

14. The tool support device as claimed in claim 12, wherein said extension of said bar includes a lock notch formed therein, said longitudinal beam includes a latch extended therefrom and engaged into said lock notch of said extension of said bar, to lock said bar to said longitudinal beam.

* * * * *